US009646582B2

(12) United States Patent
Di Cicco

(10) Patent No.: US 9,646,582 B2
(45) Date of Patent: May 9, 2017

(54) VARIABLE CHAMBERED PERCUSSION INSTRUMENTS

(71) Applicant: NATURAL ACOUSTICS LAB LLC, Pasadena, CA (US)

(72) Inventor: Albert J. Di Cicco, Pasadena, CA (US)

(73) Assignee: Natural Acoustics Lab LLC, Pasadena, CA (US)

( * ) Notice: Subject to any disclaimer, the term of this patent is extended or adjusted under 35 U.S.C. 154(b) by 0 days.

(21) Appl. No.: 15/016,218

(22) Filed: Feb. 4, 2016

(65) Prior Publication Data

US 2016/0225353 A1 Aug. 4, 2016

Related U.S. Application Data

(60) Provisional application No. 62/112,043, filed on Feb. 4, 2015.

(51) Int. Cl.
*G10D 13/02* (2006.01)
*G10D 13/06* (2006.01)

(52) U.S. Cl.
CPC ..... *G10D 13/06* (2013.01); *G10D 13/02* (2013.01)

(58) Field of Classification Search
CPC ..... G10D 13/06
See application file for complete search history.

(56) References Cited

U.S. PATENT DOCUMENTS 2,318,460 A * 5/1943 Brief ..... A63H 5/00 446/419
3,371,840 A * 3/1968 Schlager ..... B65D 25/04 217/31
3,648,400 A * 3/1972 Wolfe ..... A01K 97/06 220/835
3,703,955 A * 11/1972 Inacker ..... B65D 83/0445 206/532
4,165,671 A * 8/1979 De Bose ..... G10D 13/06 446/419
4,179,973 A * 12/1979 White ..... G10D 13/06 446/419
4,187,975 A * 2/1980 Shepherd ..... B65D 5/48038 217/31

(Continued)

FOREIGN PATENT DOCUMENTS

DE 102004046506 A1 4/2006
JP H07121558 12/1995

(Continued)

OTHER PUBLICATIONS

Natural Acoustics Lab LLC, International Search Report and Written Opinion of the International Searching Authority, issued by the USPTO in related International Patent Application No. PCT/US2016/016648 on Apr. 8, 2016.

(Continued)

*Primary Examiner* — Robert W Horn

(74) *Attorney, Agent, or Firm* — Laura M. Lloyd; Leech Tishman Fuscaldo & Lampl

(57) ABSTRACT

The present invention is a percussion instrument comprising a body enclosed on all sides by one or more walls. Internal to the body is a matrix comprising two or more compartments. One or more solid masses are located within at least one of the two or more compartments, and are used to produce sound.

14 Claims, 16 Drawing Sheets

(56) References Cited

U.S. PATENT DOCUMENTS 4,306,485 A * 12/1981 Rudkin ..... G10K 3/00 446/419
4,746,053 A * 5/1988 Nichols ..... B65D 5/48038 217/30
4,787,473 A * 11/1988 Fuchs ..... F16L 55/033 181/224
4,887,790 A * 12/1989 Wilkinson ..... A61J 3/06 206/531
4,901,617 A * 2/1990 Malone ..... G10D 13/06 84/402
5,044,250 A * 9/1991 Beyer ..... G10D 13/003 84/422.4
5,237,903 A 8/1993 Bein et al.
5,265,514 A * 11/1993 Schertz ..... G10D 13/003 446/419
D347,019 S * 5/1994 Yould ..... D17/22
5,323,678 A * 6/1994 Yould ..... G10D 13/06 84/418
5,483,859 A * 1/1996 Singer ..... A63H 5/00 446/419
5,659,143 A * 8/1997 Isackson ..... G10D 13/06 446/419
D399,346 S * 10/1998 Saari ..... D3/203.5
D418,288 S * 1/2000 Priebe ..... D3/201
6,255,572 B1 * 7/2001 Moghaddam ..... G10D 13/06 446/419
6,362,406 B1 * 3/2002 Enhoffer ..... G10D 13/06 84/402
6,362,951 B1 * 3/2002 Moribe ..... H02B 1/28 174/17 VA
6,365,810 B1 4/2002 Enhoffer et al.
D460,690 S * 7/2002 Doerschlag ..... D3/203.2
6,512,169 B1 * 1/2003 Santini ..... G10D 13/06 446/418
6,555,736 B1 * 4/2003 Delosreyes ..... G10D 13/06 84/402
6,620,991 B1 * 9/2003 Honiball ..... G10D 13/06 84/402
6,896,175 B2 * 5/2005 Duke ..... B65D 5/48038 229/120.36
D511,354 S * 11/2005 Cohen ..... D17/22
7,045,695 B1 * 5/2006 Cohen ..... G10K 3/00 446/419
7,910,816 B2 * 3/2011 Glowacki ..... G10D 13/06 446/419
8,242,342 B2 * 8/2012 Bettinelli ..... G10D 13/06 446/421
8,558,097 B2 10/2013 Krol et al.
8,648,244 B2 2/2014 Dahl
8,779,263 B2 * 7/2014 Sallee ..... G10D 13/06 446/85
9,165,541 B2 10/2015 Pires
2003/0167898 A1 9/2003 Honiball
2005/0006260 A1 * 1/2005 Moree ..... A01K 97/22 206/315.11
2009/0272249 A1 11/2009 Glowacki
2012/0055315 A1 * 3/2012 Sallee ..... G10D 13/06 84/402
2016/0225353 A1 * 8/2016 Di Cicco ..... G10D 13/02

FOREIGN PATENT DOCUMENTS

JP H096335 A 10/1997
WO 2014025351 A1 2/2014

OTHER PUBLICATIONS

Web page printout, http://www.amazon.com/Edushape-MP400-Rainmaker-16in/dp/B0002EB5SA/ref=pd_cp_MI_1, Dec. 27, 2014.

* cited by examiner

VARIABLE CHAMBERED PERCUSSION INSTRUMENTS

CROSS-REFERENCE TO RELATED APPLICATIONS

The present application claims the benefit of U.S. Provisional Patent Application No. 62/112,043 titled "Repeatable Variable-Rib Chambered Compartments and Sealed Solid Body Percussion Instrument," filed Feb. 4, 2015, the contents of which are incorporated in this disclosure by reference in their entirety.

FIELD OF THE INVENTION

This invention is related to percussion instruments and, more specifically, to the sub-categories of hand held percussion instruments known as shakers and struck percussion instruments commonly known as drums. Shakers and drums are typically used for rhythmic structure and sound effect in musical performance, music composition and sound recording.

BACKGROUND OF THE INVENTION

There are several percussion musical instruments capable of creating a rhythm. For example, shakers and drums are types of percussion capable of generating rhythmic patterns by being shaken (i.e., maracas) or struck (i.e., drums or bongos). Typically, shakers contain striker material freely disposed in an enclosed shaker. Drums contain a skin, or head, stretched outside an open chamber and are struck by hand or with a stick or mallet to produce sound. In contrast, shakers are rarely struck to produce sound, and drums are not shaken to produce sound. However, there are limitations to shakers and drums. While a percussionist may produce sound variations and rhythmic patterns when using a shaker or drum, a single instrument is not capable of being played simultaneously as both a shaker and drum, with a wide range of performance techniques. Additionally, shakers and drum categories are limited in scale (i.e., maracas), which further reduces the amount of sound variety achieved with a single instrument.

There are a limited number of percussion instruments that can be used as shakers. These instruments are limited in their architectural features, scale and intended performance application and playing technique.

One instrument, disclosed in U.S. Pat. No. 4,306,485 ("the '485 patent"), is a shaker instrument that requires baffles for each and every chamber/compartment. The '485 patent requires compartment walls that must be placed in an opposite facing direction for the baffles to achieve maximum effect. Additionally, the baffles must be placed mid-instrument. Furthermore, the '485 patent is limited to the use of a tube-shaped instrument.

Another reference, U.S. Pat. No. 5,323,678 ("the '678 patent"), has chamber walls that are permanently affixed to the outer wall of the instrument, creating distinct chambers that are immovable and fixed. Because of this, the instrument cannot be entirely muted when held in a tight grasp by the user. Additionally, this instrument cannot be played as intended if it is scaled to a large diameter that exceeds the performer's span of reach or height. The instrument has multiple outer walls fused to the various sound chambers. The '678 patent also specifies that a drum head is fixed onto the instrument in order to be used for drumming. The instrument disclosed in the '678 patent is not practically scaled to very small sizes because it is intentionally meant to be performed as a tambourine or drum-like instrument.

In addition, PCT publication WO2014/025351 discloses an instrument in which every wall surface is a single plate that is mounted with other plates. Tubes are used to encompass the "striker" material. The instrument is not intended to be constructed as a stick or curvilinear stick, it is not intended to be played like a drum, is unplayable when scaled to a dimension of eight or more feet in length, nor is it intended to be played with muted or unmated performance variations. It is intended to be played with a circular or elliptical motion.

Thus, there is a need for a percussion instrument that overcomes the deficiencies of the aforementioned percussion instruments. There is a need for a single instrument that contains the performance elements of both shakers and drums, that is scalable and capable of generating a unique range of sounds.

SUMMARY

The present invention is directed to percussion instruments that contain the performance elements of both shakers and drums that are scalable and capable of generating a unique range of sounds. In one embodiment, a percussion instrument contains a body which is enclosed on all sides by one or more walls. The percussion instrument contains a matrix that is integral to the enclosed body. It is contemplated that the matrix has two or more compartments. The percussion instrument also contains one or more solid masses, used as a striker to generate noise, located within at least one of the two or more compartments. In one aspect, the enclosed body comprises a cuboid shape and can contain a top wall, a bottom wall, and four side walls. The cuboid shape can be a rectangular or square shape. In one aspect, the matrix is arranged in a checkerboard pattern. The one or more walls can be between about 1 and about 25 mm in thickness. The compartments can be between about 3 and 300 mm in length, between about 3 and 300 mm in width, and between about 3 and 150 mm in height. In one aspect, the enclosed body is a cylindrical shape. In one aspect of the embodiment, the length of the body is between about 25 to about 3,000 mm. In another aspect of the embodiment, the width of the body is between about 3 to about 600 mm.

In another aspect of the embodiment, the height of the body is between about 3 to about 300 mm. In another aspect, the number of compartments can range from about 2 to about 40,000 compartments. In yet another aspect, the solid masses are from about 1 mm in diameter to about 150 mm in diameter. It is contemplated that each of the compartments contain from 1 to 1,000 solid masses. In one aspect of the invention, the body may be disassembled. It is contemplated that the components of the instrument of the invention, including the body, matrix, and solid masses, can be made of plastic, metal, wood, rubber, nylon, vinyl, carbon fiber, composite synthetic materials, or a combination thereof. It is contemplated that the solid masses fill from one percent to seventy-five percent of the volume of at least one of the two or more compartments.

In one embodiment of the present invention, there is provided a method of playing the percussion instrument, wherein the percussion instrument may be played by a user shaking the instrument, tapping the instrument, striking the instrument, drumming the instrument, or a combination thereof.

In another embodiment, there is provided a percussion instrument comprising a) a body comprising a cuboid and enclosed on all sides by one or more walls, where the width of the body is between about 25 and 600 mm, where the length of the body is between about 25 and 3,000 mm, wherein the height of the body is between about 3 and 150 mm, and where the one or more walls are between about 1 and about 25 mm in thickness; b) a matrix having two or more compartments, where the matrix is integral to the enclosed body, and where the compartments are between about 3 and 300 mm in length, between about 3 and 300 mm in width, and between 3 and 150 mm in height; and c) one or more solid masses, wherein the one or more solid masses are integral to at least one of the two or more compartments; and where the one or more solid masses are between about 1 and 100 mm in diameter.

In one embodiment, there is provided a percussion instrument having a) a body, the body having a cylinder and enclosed on all sides by one or more walls, the cylinder comprising a height between about 3 and 300 mm, and a diameter between about 3 and 300 mm, and where the one or more walls of the body are between about 1 and about 25 mm in thickness; b) a matrix comprising two or more compartments, where the matrix is integral to the enclosed body and extends the width of the body, and where the compartments are between about 3 and 300 mm in length, between about 3 and 300 mm in width, and between 3 and 300 mm in height; and c) one or more solid masses, where the one or more solid masses are integral to at least one of the two or more compartments; and where the one or more solid masses are between about 1 and 150 mm in diameter.

In one embodiment, there is provided a percussion instrument comprising a) a body, the body having a curvilinear shape, the body enclosed on all sides by one or more walls, where the width of the body is between about 3 and 300 mm, where the length of the body is between about 25 and 3,000 mm, and where the height of the body is between about 3 and 300 mm, and where the one or more walls of the body are between about 1 and about 25 mm in thickness; b) a matrix comprising two or more compartments, where the matrix is integral to the enclosed body and extends the width of the body, and where the compartments are between about 3 and 300 mm in length, between about 3 and 300 mm in width, and between 3 and 300 mm in height; and c) one or more solid masses, wherein the one or more solid masses are integral to at least one of the two or more compartments; and where the one or more solid masses are between about 1 and 150 mm in diameter.

DRAWINGS

These and other features, aspects, and advantages of the present invention will become better understood with regard to the following description, appended claims, and accompanying drawings.

DESCRIPTION

Figure 1A:
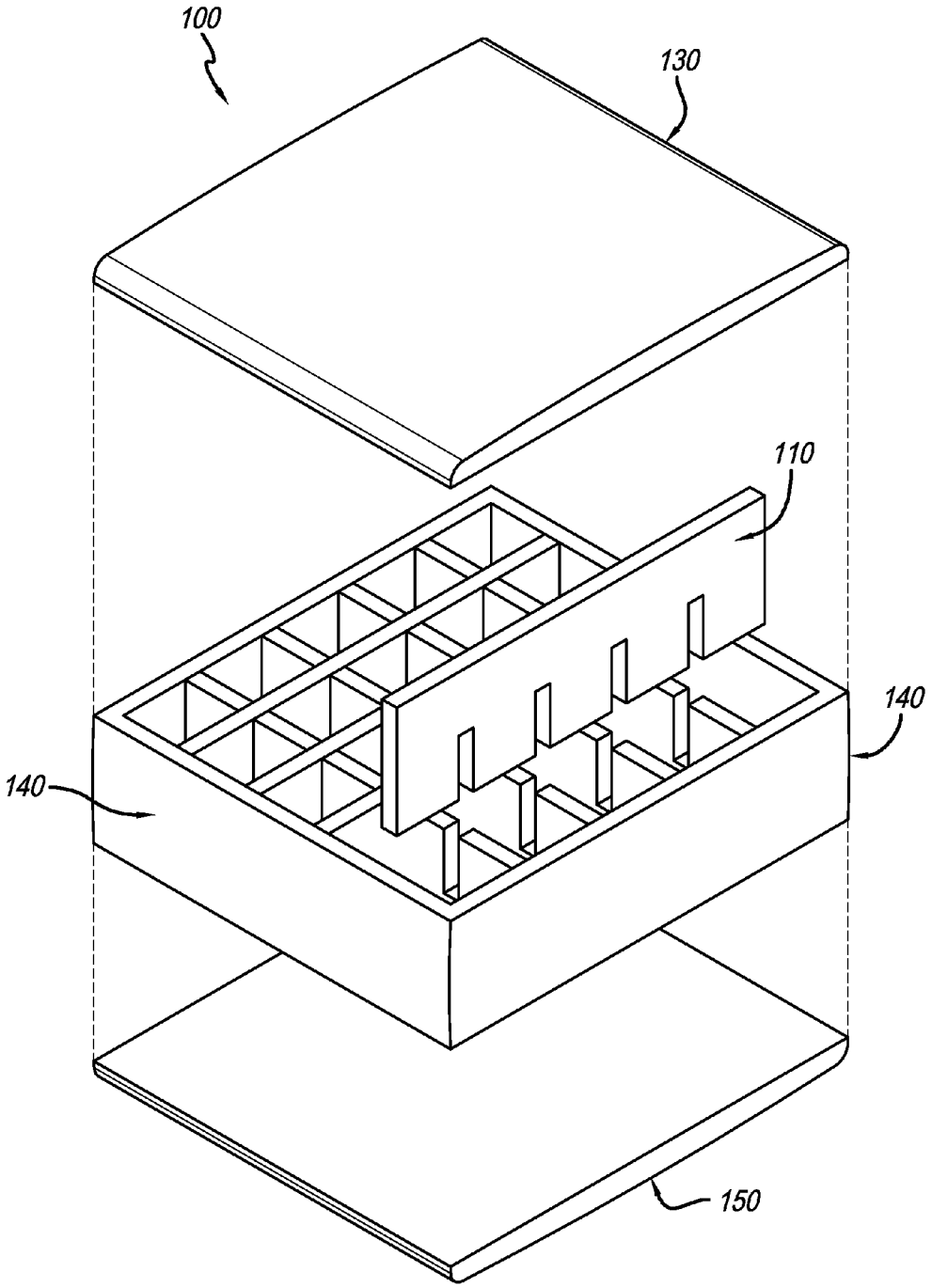
FIGS. 1A-1F depict one embodiment of the invention with a cuboid-shaped "box" shaker with internal chambers formed from an assembled matrix of dadoed slats.

As used herein, the following terms and variations thereof have the meanings given below, unless a different meaning is clearly intended by the context in which such term is used.

The terms "a," "an," and "the" and similar referents used herein are to be construed to cover both the singular and the plural unless their usage in context indicates otherwise.

The terms "chambers" and "compartments" are used interchangeably and describe the confined space through which striker material may travel through before an internal surface of the instrument is struck, thus generating sound. Compartments can be the same size throughout the instrument, or can be variable sizes. The compartments are formed by a matrix which is inside the instrument. The matrix can be constructed from plastic, metal, wood, rubber, nylon, vinyl, carbon fiber, composite synthetic materials, or a combination thereof.

The term "baffle" means an empty chamber or cavity, containing no striker or solid masses, meant to amplify sound from adjacent "sounding" chambers.

As used herein, the term "comprise" and variations of the term, such as "comprising" and "comprises," are not intended to exclude other components.

As used herein, the term "dadoed" means implemented through the use of dadoes. A dado is a rectangular groove cut to make a joint, typically in woodworking. When multiple dadoes are connected at opposing right angles in a manner where the cut joints are interlocked, a lattice or matrix structure is formed and creates a checkerboard pattern.

The term "matrix" refers to a lattice-work created by the interlocking of multiple dadoes. A checkerboard pattern of chambered compartments is created. A matrix may also exist as a single in-line row of compartments.

A "cuboid," "cuboid shape," or "cuboid-box" refers to a solid object that has six rectangular faces joined together at right angles to each other.

A "solid mass," "striker material," or "strikers" refers to a solid or semi-solid material that is placed into one or more compartments and generates sound when struck against each other or against a wall of the compartment or an inner wall of the instrument. A solid mass can be made of any material or shape, or any combination of material or shape, such as, for example, plastic, metal, wood, rubber, nylon, vinyl, dried beans, rice, pebbles, carbon fiber, composite synthetic materials, beads, BBs, ball bearings, glass marbles, dice/die/cubes, polyhedrons, or a combination thereof. Different sizes of solid masses may be used for maximum volume effect and to achieve timbre/tonal variation in an instrument. The shape of the solid masses does not need to be uniform, such as non-uniform pebbles or dried beans.

As used herein, the "x axis" refers to the playing of an instrument while holding it flat and parallel to the floor. The "y axis" refers to playing the instrument lengthwise and perpendicular to the floor. The "z axis" refers to playing the instrument in a "spear-like fashion" and playing the instrument as a spear while being held parallel to the floor.

There is a need for a single instrument that contains the performance elements of both shakers and drums, that is capable of generating a unique range of sounds. The present invention meets that need. The device of the present invention is capable of being played along the x, y and z axis, giving it broad rhythmic potential and sound variance capability. Additionally, the device of the present invention is not limited in scale and allows for a wide variety of sounds to be generated by single instrument depending on the size of the instrument, as well as the number of compartments and solid masses present in the instrument.

The percussion instrument of the present invention is constructed in a manner that creates confined, variable dimension compartments for free-flowing, sound producing striker material. The striker material is formed by one or more solid masses, and generates sound by hitting the wall of the compartment, the wall of the instrument's body, or another solid mass. The compartments delineate the distance for a striker to travel in order to generate sound. As such, the distance in a compartment is substantially reduced and confined, in contrast to shakers that use large chamber or single chambered architectures. These variable-sized chambered compartments are repeated through the inside of the instrument, so that the compartments formed by the repeatable ribs/walls of the matrix can support multiple performance techniques under strict control of the performer.

The percussion instrument of the present invention has other benefits over previously developed instruments, including that the sound of the instrument is easily controlled by a musician. Additionally, the instrument supports a wider range of playing techniques than traditional shaker instruments or drum-able instruments might allow. The addition of two or more compartments also significantly enhances control of the dynamic range of the instrument by the user. For example, the instrument can be played with variable volumes, such as a soft volume or loud volume.

Additionally, the percussion instrument of the present invention can produce different percussion effects and sounds through variations in instrument size, instrument shape and types of materials used for the body, the matrix, and the solid masses. Utilizing unique types of instrument from factors and construction materials fundamentally do not change the playability and versatility of an individual instrument, only its timbre or tone.

The body of the percussion instrument is made of material such as, for example, plastic, metal, wood, rubber, nylon, vinyl, carbon fiber, composite synthetic materials, or a combination thereof.

The matrix of the percussion instrument is made of material such as, for example, plastic, metal, wood, rubber, nylon, vinyl, carbon fiber, composite synthetic materials, or a combination thereof. It is contemplated that the number of compartments in the percussion instrument can be from 2 to 40,000.

The solid masses are made of material such as, for example, plastic, metal, wood, rubber, nylon, vinyl, dried beans, rice, pebbles, carbon fiber, composite synthetic materials, or a combination thereof. It is contemplated that the solid masses comprise from one percent to seventy-five percent of the volume of at least one of the two or more compartments. Additionally, it is contemplated that 1 to 1,000 solid masses are contained in one or more compartments. It is also contemplated that the solid masses be 1 mm in diameter to about 150 mm in diameter. However, a combination of sizes can be used in the instrument.

The percussion instruments described above have several advantages over instruments previously described or available. One advantage is the ability of the instrument to be played along the x, y and z axes and generate discernibly different timbres. This is governed by the type of internal surface area struck by the solid material. Each axis direction will generate greater or lesser amounts of sound generation. This includes the ability to make distinctive percussive sounds by playing or tracing "shapes" in the air (i.e., a figure eight) while simultaneously altering the axes of the instrument.

Additionally, the percussion instrument of the present invention facilitates numerous playing techniques which include, but are not limited to, shaking, waving, flicking, striking (against, for example, a palm or lap), rattling (such as, for example, a pendulum motion), finger tapping and hand drumming.

Another advantage is that the percussion instrument of the present invention can be voiced to emit high frequency, middle frequency and low frequency tones. This is achieved by: 1) scaling the size of the body of the instrument, 2) scaling the size of the sound generating solid masses, or striker material and 3) changing the material used to fabricate the outer and inner instrument components (i.e., wood, plastic, metal, PVC, composite hybrid material). A cylinder shaker may be from an inch in length to several feet in length. A box shaker may be less than an inch square or exceed the size of a ten foot long plank. Striker material types and sizes will affect the timbre/sound of the instrument. Smaller solid masses emit a higher frequency whereas larger strikers emit a lower pitched sound. Incorporating harder materials (i.e., hardwoods or metal) for cylinder and cuboid instruments will yield a more brilliant sound. Softer materials (i.e., soft plastics or soft woods) will yield a warmer or muted sound.

An additional advantage is that the instrument of the present invention supports a highly manageable transition from low to high volumes. Typical shaker instruments (such as maracas) transition from zero decibels (0 db) to peak volume upon the first strike or shake of the instrument. The embodiments described in the present invention support complete control of volume during playing, as in the complete and noticeable transition from very soft volumes to the peak volume achievable by the instrument. Volume also changes greatly depending on the size and scale of the instrument. A large instrument is capable of very loud volumes whereas a small instrument will achieve a far lower peak volume. Nonetheless, each embodiment will support a manageable transition from zero decibels to peak volume.

Each embodiment of this invention supports a voicing known as "muting." This is true of both the cylinder and cuboid embodiments. When "muting" an instrument, the performer clasps a hand (or both hands) firmly around the instrument, thereby creating a muted sound. The muted sound "deadens" or eliminates the high frequency pitches generated by the instrument. By relaxing the clasp of the hand/hands, higher frequencies are once again allowed to pass from the instrument. The process of muting and unmuting provides dramatic effect during the performance of a complex rhythmic pattern and is a technique few hand held shakers possess. With expert playing, the muting and unmuting process can also produce specific vowel-like sounds such as "OO," "EE" and "AH".

The intent of each embodiment is to maximize the balance of instrument scale, striker material size, construction material and inner dimension of the chambers. Unlike single chambered or "tubed" chamber percussion, this invention relies on restricted chamber sizes to ensure that the performer can achieve rapid effect, clean articulations, and crisp sound generation. This is especially evident in the instrument ability to achieve a crisp and definite "halt" in performance. By using the x, y and z axes to the greatest extent, a performer can readily change the angle of the instrument direction to quickly halt the movement of striker material and prevent striker material from traveling further than intended.

This instrument marks a distinct departure from related shaker instruments when it is finger-tapped or drummed while sitting in the performer's lap. The instrument no longer relies on arm motions for striker sound generation, but creates sound through the deployment of finger-tapping or drumming of the instrument while resting on the performer's lap. This technique of playing achieves a highly differentiated sound from that of a shaker and approaches more closely the sound of a snare drum. This is especially true in FIG. 3, where a large rectangular cuboid-box shaker can rest the full width of the performer's lap and be filled from right-to-left (or vice versa) with different sized strikers to emulate/imitate the sound and effect of a kick drum, snare drum and cymbal/hi-hat.

Additionally, the instrument of the invention is intended to be manufactured in various hardwoods (such as, for example, walnut, ash, maple, cherry etc.), metals, plastics, composite materials (such as, for example, carbon fiber) and vinyls (such as, for example, PVC). The internal solid mass strikers may also utilize various materials including but not limited to metals, woods, plastics, vinyl, glass and various shapes including balls, dice/die/cubes, or polyhedrons.

The outer frame of the instrument may be modified without affecting the internal sound generating architecture. Various shapes may include cylindrical, squared, cubed, curvilinear, oblong, triangular or polyhedral.

This instrument can be fashioned into artistic curved shapes (such as shown in FIG. 4) without any impact of the playability of the instrument. This makes the instrument especially attractive for manufacture as a consumer/entertainment/play object that persons might find at sporting, entertainment or other recreational venues.

Figure 1B:
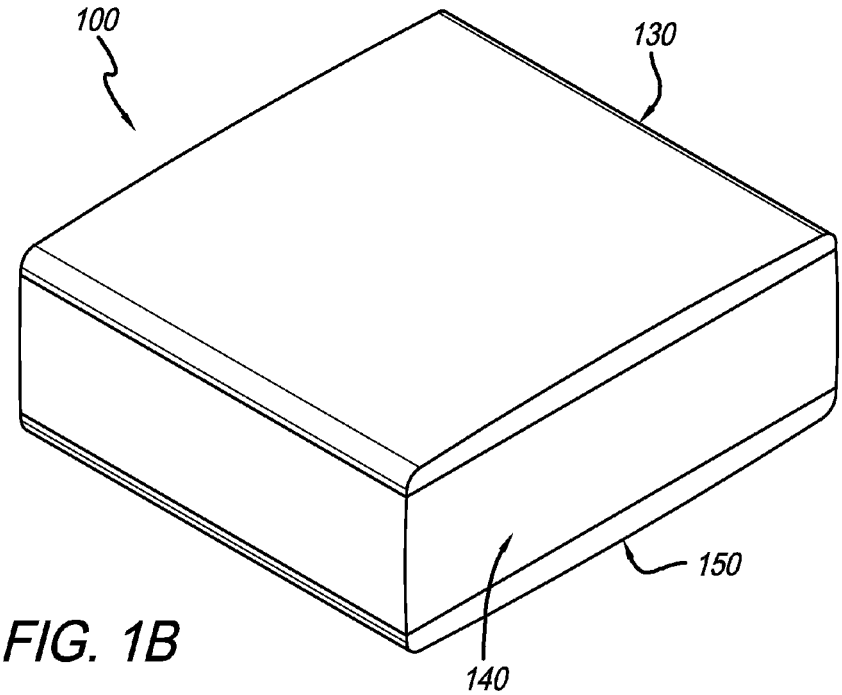

There are several embodiments of this invention. The first embodiment, shown in FIG. 1, is that of a cuboid-box shaker 100. The body of the cuboid-box shaker 100 contains an internal lattice of variable compartments. The body is formed by the assembly of a top wall 130, a bottom wall 150, and four side walls 140, as shown in an expanded view in FIG. 1A. The top wall 130 and bottom wall 150 are identical in size and shape. The inside of the body is filled with a lattice-work of compartments formed by dadoed, or grooved, slats 110 which are interlocked together to form a matrix in opposing and perpendicular directions to each other. Each compartment of the matrix is then filled with sound generating solid masses 120 used to hit or strike the inside walls of the instrument to generate percussive sound. The final assembly is a sealed, solid body instrument that does not have baffles or escape holes to enhance sound generation, as shown in FIG. 1B. There are three primary striking surfaces involved in this embodiment: 1) the side wall 140, 2) the matrix walls formed by the slats 110 and 3) the top wall 130 and bottom wall 150. It is contemplated that the width of the cuboid-box shaker 100 is between about 25 and 600 mm, the length of the cuboid-box shaker 100 is between about 25 and 3,000 mm, and the height of the cuboid-box shaker 100 is between about 10 and 150 mm. It is also contemplated that the walls of the cuboid-box shaker 100 are between about 1 and about 25 mm in thickness.

Figure 1C:
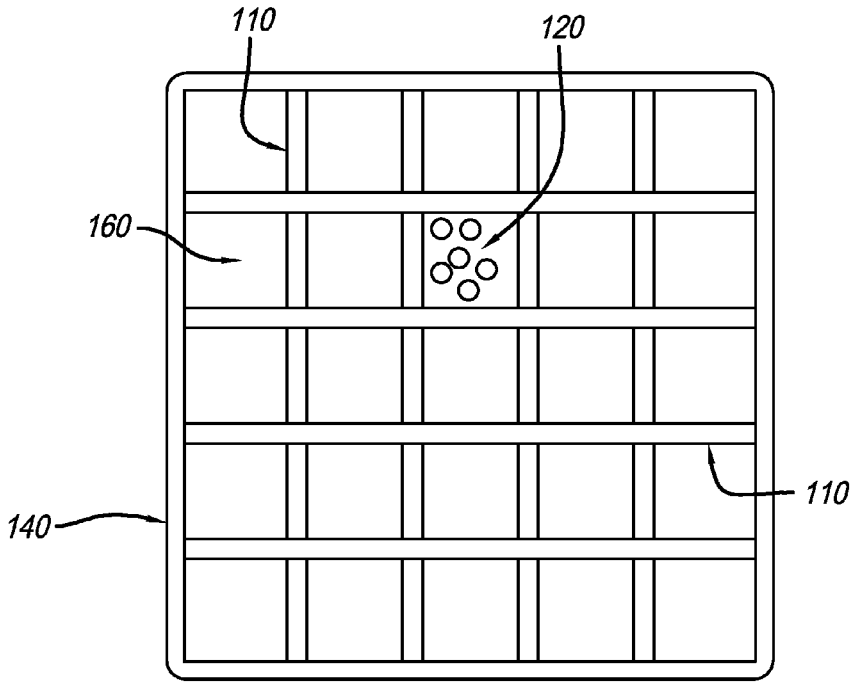

FIG. 1C illustrates the top interior view of the cuboid-box shaker 100 with the chambered compartments 160 formed by the dadoed slats 110. Also shown is one chambered compartment 160 filled with solid masses 120. In a preferred embodiment, all of the chambered compartments 160 will be filled with one or more solid masses 120.

Figure 1D:
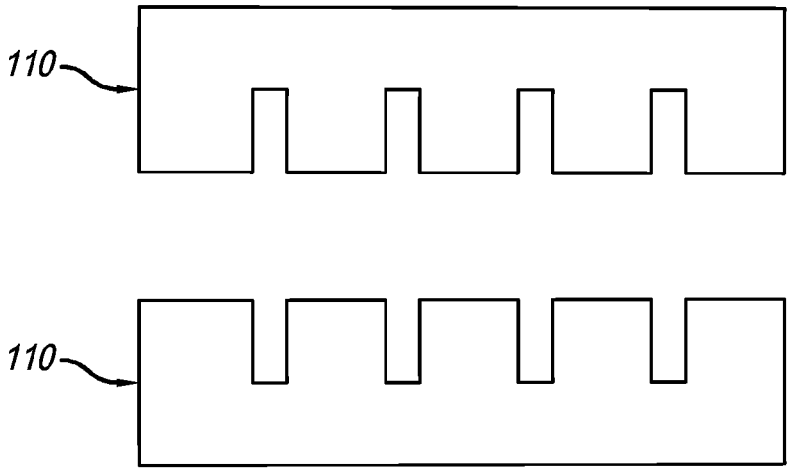
Figure 1E:
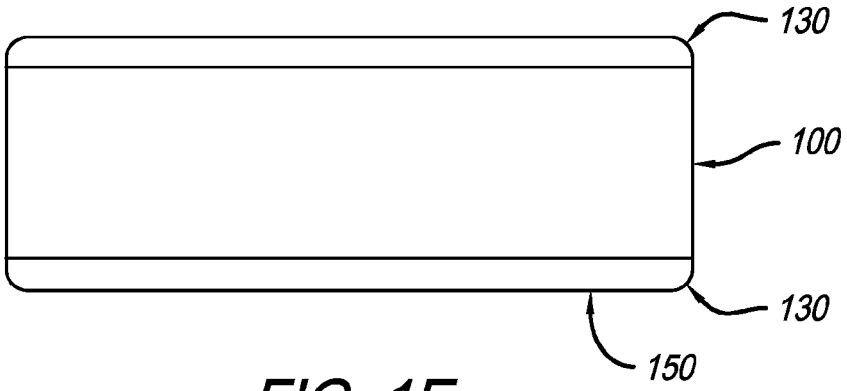
Figure 1F:
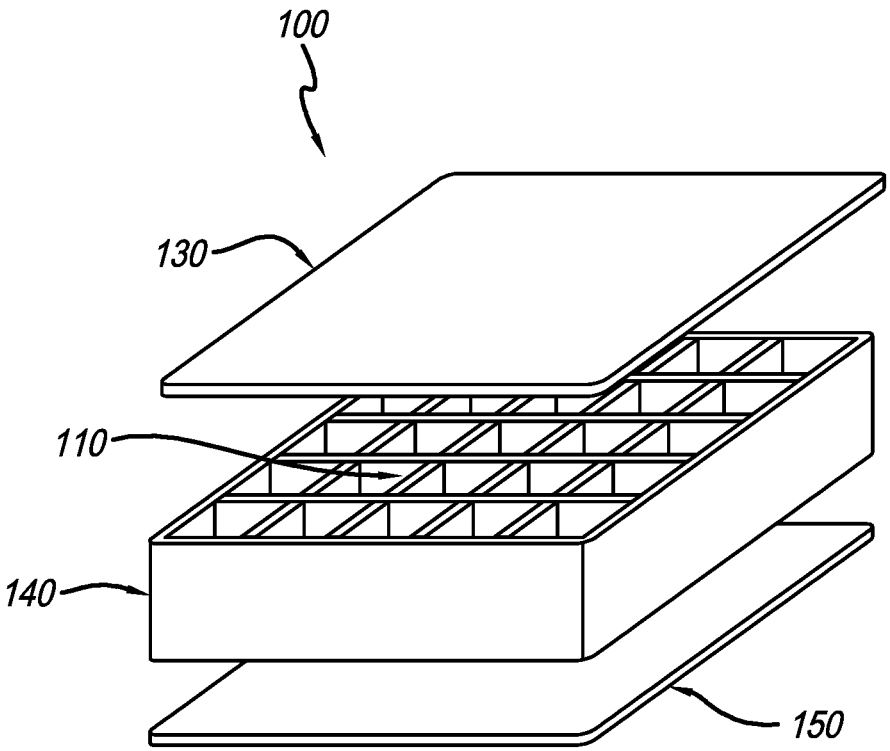

FIG. 1D illustrates the dadoed, or grooved slats 110. These slats interlock when fitted together in opposing and perpendicular positions, thus creating the inner lattice-work, or matrix, of the cuboid-box shaker 100. FIG. 1E shows the side view of the cuboid-box shaker 100, and FIG. 1F shows a perspective view of the cuboid-box shaker 100. Sealing of the instrument takes place after one or more solid masses are inserted into one or more chambers.

Furthermore, it is contemplated that the compartments 160 are between 3 and 300 mm in length, between 3 and 300 mm in width, and between 3 and 150 mm in height.

Figure 2A:
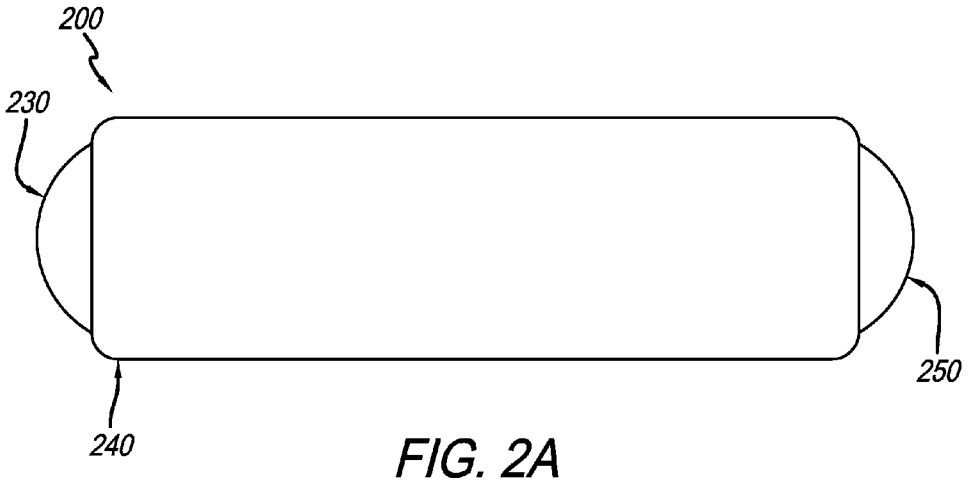
FIGS. 2A-2H depict a second embodiment of the invention possessing a cylindrical-stick shaker with an in-line row of internal chambers.
Figure 2B:
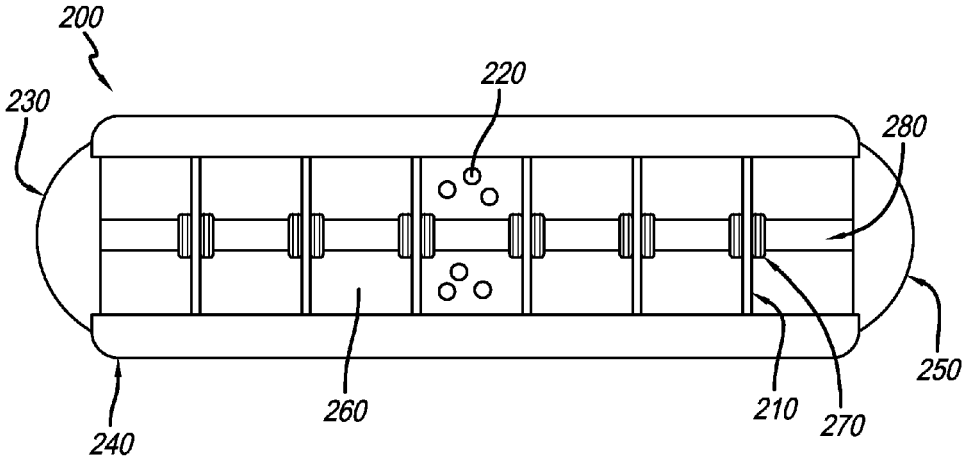
Figure 2C:
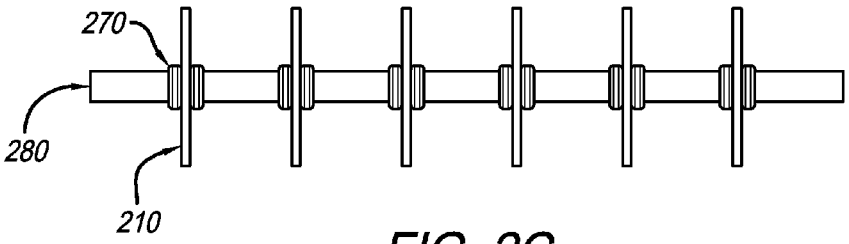

The second embodiment, shown in FIG. 2A, is that of a cylindrical, or stick shaker body 200. As shown in FIG. 2B, the cylindrical body is made up of a cylinder wall 240 containing a single in-line matrix of compartments 260. The cylinder wall 240 is hollow, allowing for the insertion of the internal shaker mechanism containing a matrix and solid masses 220. In this case, the matrix is a dowel or rod 280 containing grommets 270 spaced along the length of the rod 280, as shown in FIG. 2C. Fit onto each grommet 270 is a washer 210 that forms the compartments 260 where the sound generating solid masses 220 are placed. Two end caps 230, 250 are then affixed to the cylinder wall 240 to seal the cylinder. The grommet 270 and washer 210 assembly restricts the solid masses 220 from travelling outside of the chambered compartment 260. The final assembly is a sealed, solid body instrument that uses no baffles or escape holes to enhance sound generation. There are two primary striking surfaces involved in this embodiment: 1) the wall of the cylinder 240 and 2) the internal chamber formed by the grommet 270 and washer 210, and the end cap walls 230, 250.

Figure 2D:
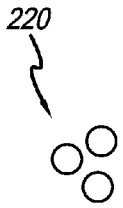
Figure 2E:
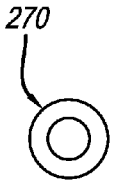
Figure 2F:
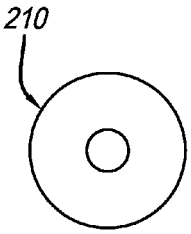
Figure 2G:
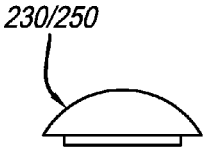
Figure 2H:
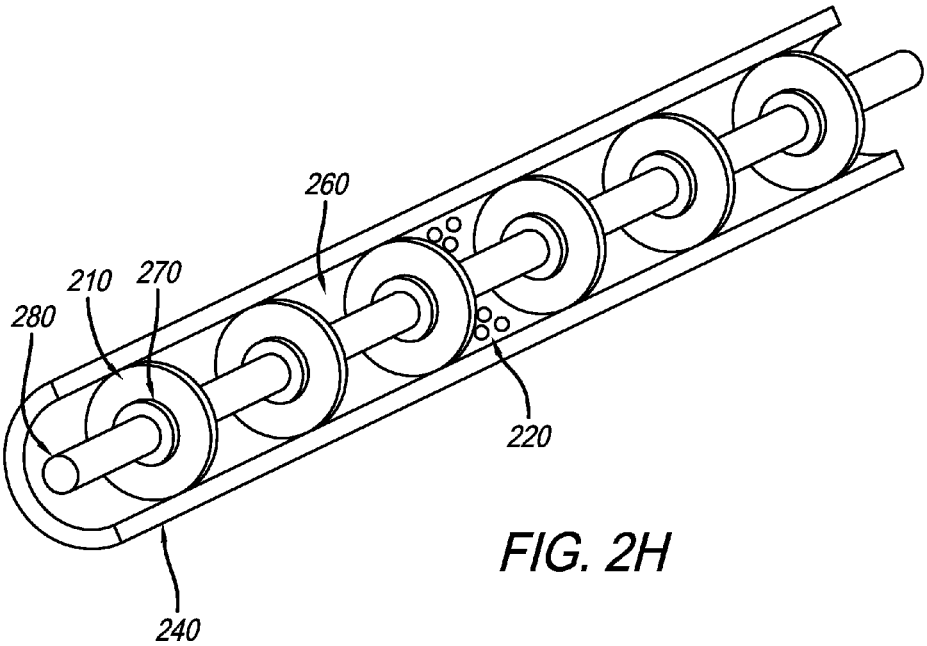

FIG. 2D illustrates a solid mass 220. One or more solid masses may be placed within each chambered compartment 260. FIG. 2E depicts a washer 210 whose inner diameter is sized to accommodate a grommet 270 and whose outer diameter is sized to fit snugly into the hollow interior of the cylinder wall 240 in order to restrict the solid masses 220 from travelling outside of the compartment 260. FIG. 2F shows a grommet 270 with an outer diameter sized to be fitted into a washer 210 and whose inner diameter is sized to fit onto the rod 280. FIG. 2G illustrates an end cap 230, 250. The end cap is sized to be inserted into the end of the cylinder wall 240 and be fixed into place by any means such as, for example, screwing the end cap 230, 250 into a threaded barrel located insider the cylinder wall 240, inserting and twisting the end cap 230, 250 into a twist-lock mechanism located inside the cylinder wall 240, or snapping the end cap into a snap-into ring located inside the cylinder wall 240. FIG. 2H is a perspective view of the second embodiment of the invention.

Figure 3A:
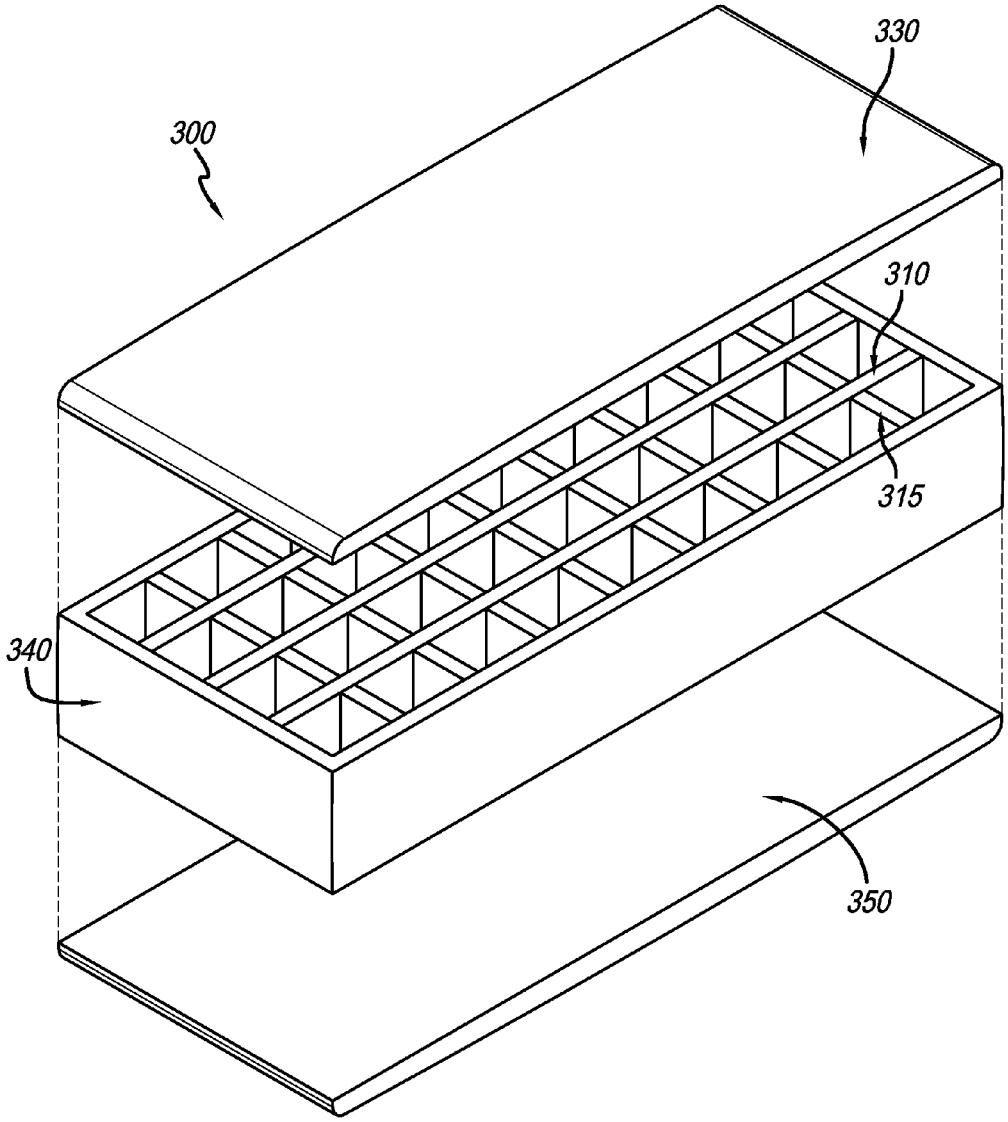
FIGS. 3A-3F depict a third embodiment of the invention possessing a rectangular cuboid-shaped "box" shaker with internal chambers formed from an assembled matrix of dadoes.

The third embodiment, shown in an expanded view in FIG. 3A, is that of a percussion instrument with a rectangular cuboid-box body 300. The instrument has an internal matrix of compartments 360, capable of being played as a hand or lap rested drum. Besides supporting typical hand held shaker motions, the rectangular cuboid-box body 300 is especially effective as a lap-rested drum-able percussion instrument. The cuboid-box is formed by the assembly of a top wall 330, a bottom wall 350, and four side walls 340. The matrix is formed by dadoed, or grooved, long slats 310 which are interlocked with grooved short slats 315 to form numerous chambered compartments 360. The inside of the compartments 360 contain sound generating solid masses 320 that strike the internal top wall 330, bottom wall 350, side walls 340 and slats 310, 315 to generate percussive sound. One or more solid masses 320 may be placed within each compartment. The solid masses are shown in FIG. 3B.

Figure 3C:
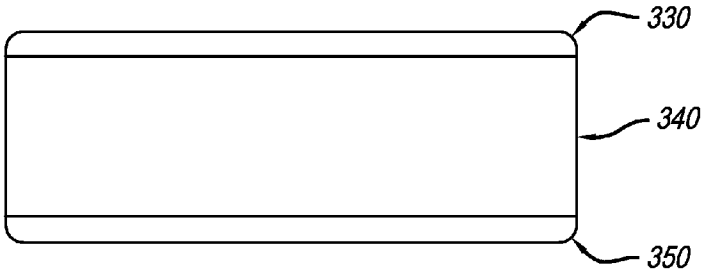
Figure 3B:
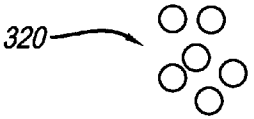

FIG. 3C illustrates a side view of the finished embodiment percussion instrument with a rectangular cuboid-box body 300 containing top wall 330, a bottom wall 350, and four side walls 340. The final assembly is a sealed, solid body instrument that uses no baffles or escape holes to enhance sound generation.

Figure 3D:
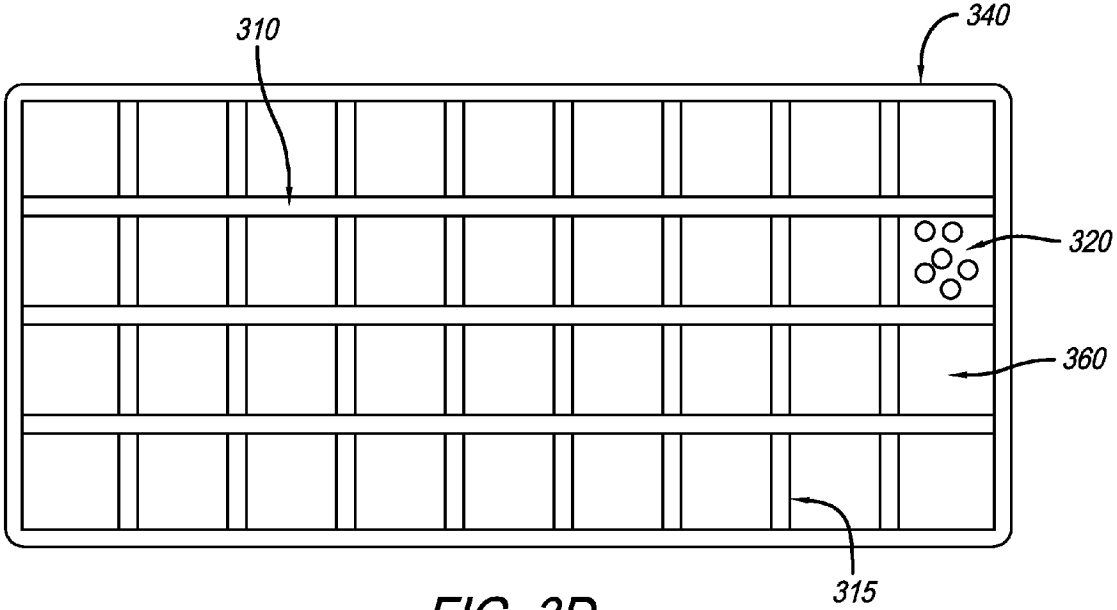
Figure 3E:
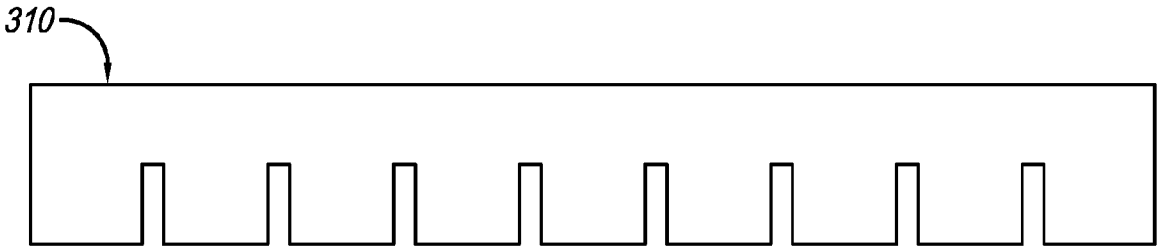
Figure 3F:
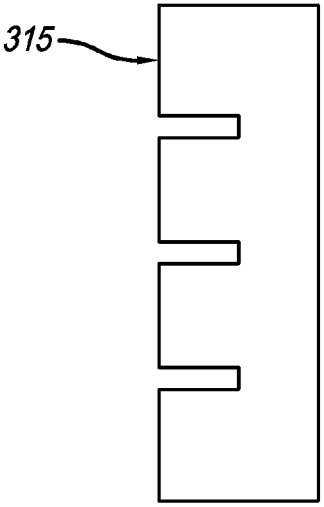

FIG. 3D shows a top view of the completed lattice-work, or matrix, formed by the long slats 310 which are interlocked with grooved short slats 315 to form numerous chambered compartments 360. Shown is one compartment 360 filled with solid masses 320. In a preferred embodiment, each of the compartments 360 contain one or more solid masses. The long slats 310 are also shown in FIG. 3E, and the short slats 315 are also shown in FIG. 3F.

It is contemplated that the width of the body of the percussion instrument with a rectangular cuboid-box body 300 is between about 25 and 600 mm, the length of the body is between about 25 and 3,000 mm, and the height of the body is between about 10 and 150 mm. It is also contemplated that the walls of the body are between about 1 and about 25 mm in thickness. Furthermore, it is contemplated that the compartments 360 are between 3 and 300 mm in length, between 3 and 300 mm in width, and between 10 and 150 mm in height.

This rectangular cuboid-box body 300 provides a plurality of compartments 360 whereby mixed sizes of sound generating strikers such as solid masses 320 may be used. This is especially helpful for drum-able, lap-rested instrument performance. For instance, some of compartments 360 could be populated with large solid masses 320 to emulate a large, low frequency kick drum and the opposing side populated with small solid masses 320 to emulate a small, higher frequency snare drum. By drumming separate sides in a rhythmic pattern, an emulated drum sound occurs. The performer also has the option of taking a lap-rested instrument, lifting it (or one side) into the air and striking it against the lap. This additional motion gives an emulated cymbal or hi-hat sound to the lap-rested drum performance.

The fourth embodiment, shown in an expanded view in FIG. 4, is that of a curved box or curvilinear "stick" shaker 400 containing a single in-line row of variable sized compartments 460 formed by slats 410. In one aspect, the side walls 440 and slats 410 forming the compartments 460 can be constructed as a solid unit. In use, the compartments 460 restrict the area in which striker materials 420 may travel. To assemble the curvilinear shaker 400, sound generating solid masses 420 are inserted into each compartment 460 and the instrument is sealed by affixing a top wall 430 and a bottom wall 450. The final assembly is a sealed, solid body instrument that uses no baffles or escape holes to enhance sound generation. FIG. 4B shows an assembled curvilinear shaker 400 that uses no baffles or escape hole to enhance sound generation. FIG. 4C depicts a round type of the solid masses 420 used in the instrument.

Figure 4A:
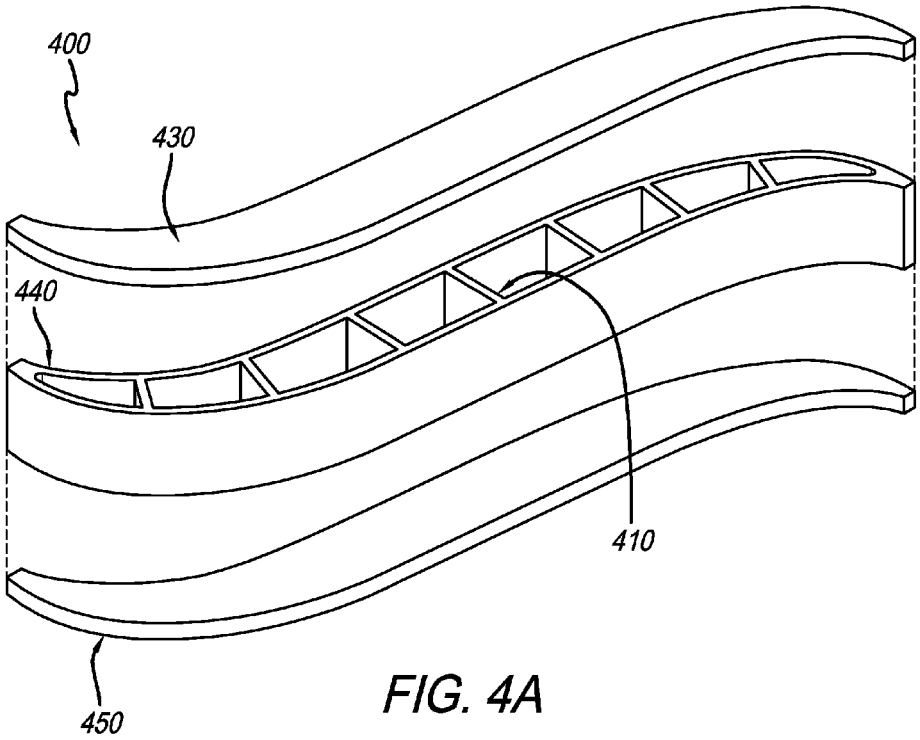
FIGS. 4A-4D depict a fourth embodiment of the invention possessing a curvilinear "stick" shaker with a body containing an integrated row of in-line internal chambers.
Figure 4B:
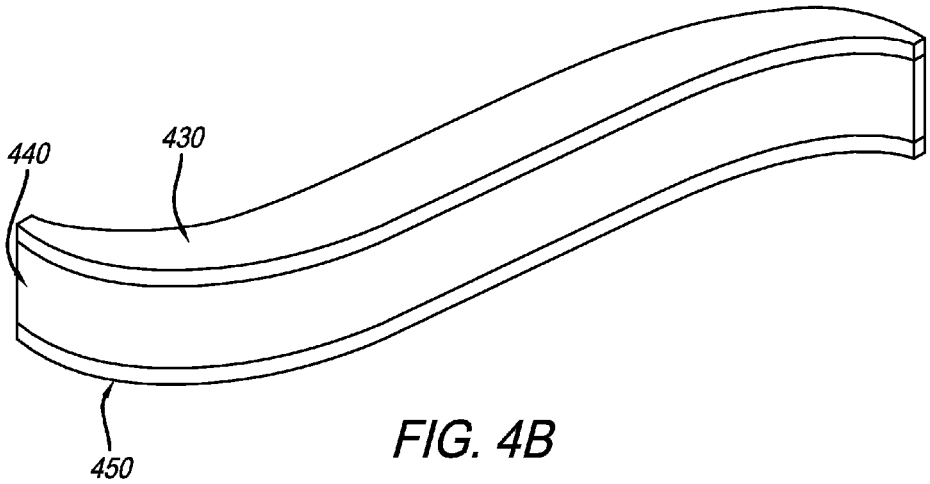
Figure 4C:
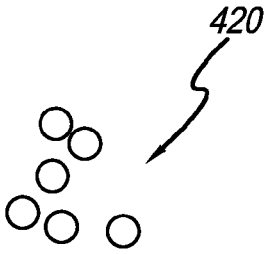
Figure 4D:
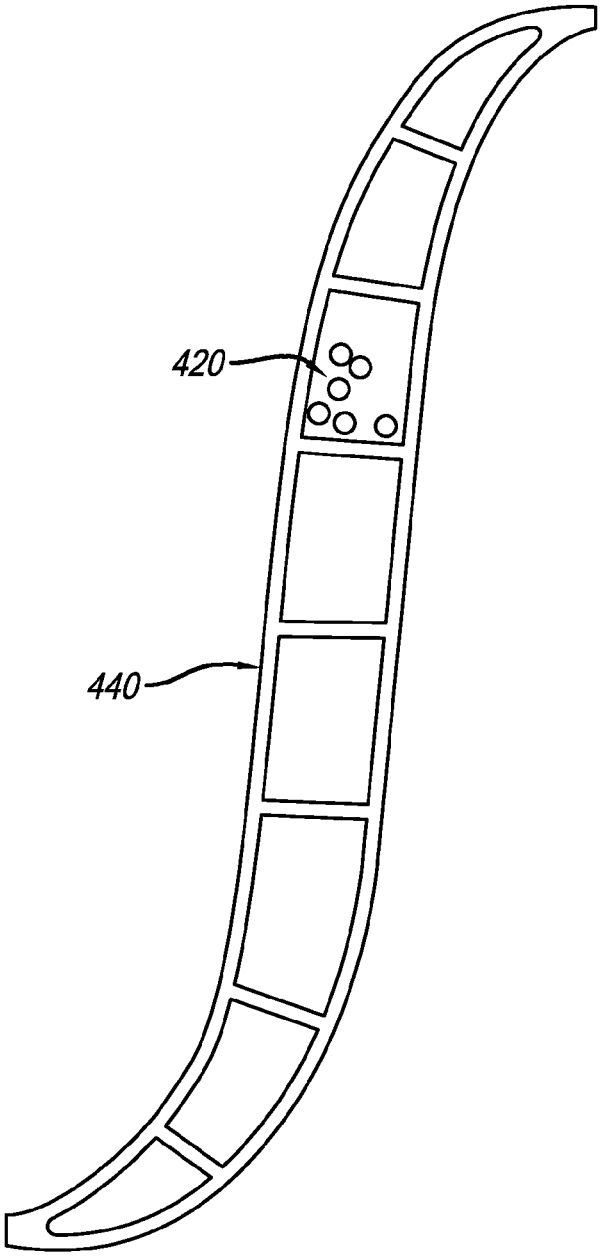

FIG. 4D illustrates solid masses 420 placed within one compartment of the curvilinear shaker 400. There are three surfaces against which the solid masses 420 can strike: 1) the side wall 440, 2) the walls of the slats 410 forming the compartment 460, and 3) the top wall 430 and bottom wall 450 which act as a drum head/skin. In a preferred embodiment, one or more solid masses 420 are placed within each compartment 460.

Figure 5A:
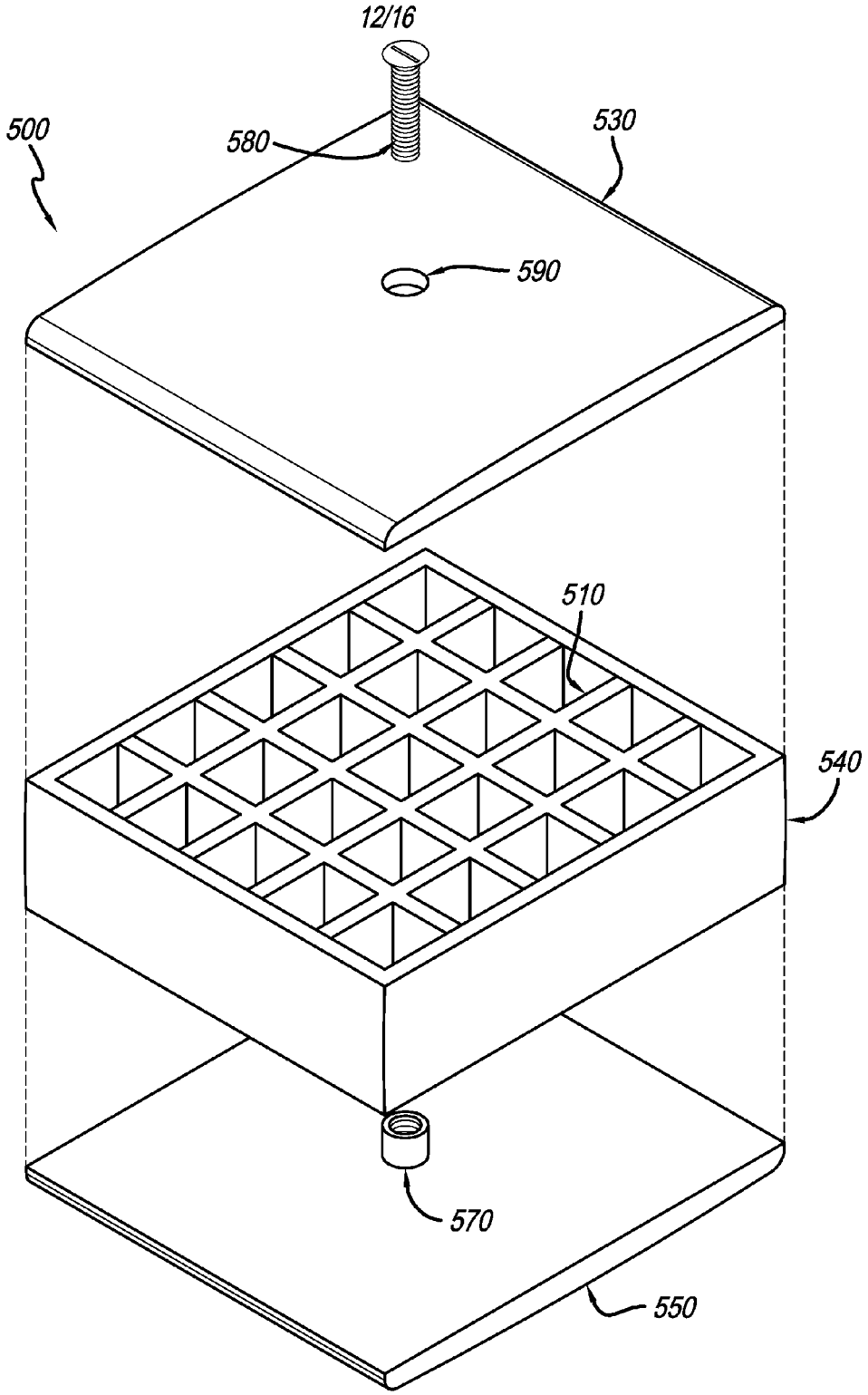
FIGS. 5A-5E depict an alternative of the first embodiment of the invention possessing a cuboid-shaped shaker with removable faceplates and a lattice-work/matrix component. This embodiment is meant to be a "user-configurable" instrument.

The fifth embodiment, an expanded view shown in FIG. 5A, provides a user-configurable cuboid-box shaker 500 which can be opened and closed. The user-configurable instrument may be either square or rectangular in shape. It may be opened, reconfigured and closed again. The user can exchange inner components in order to alter the instrument sound. The user-configurable cuboid-box shaker 500 is formed by the assembly of a side wall 540 joined with a top wall 530 and a bottom wall 550 by any means, such as, for example, a barrel screw 580. The top wall 530 has one or more holes 590 drilled into it to support the insertion of one or more screws 580. The bottom wall 550 has one or more threaded barrels 570 mounted onto its interior plane or through it in order to receive the locking screw 580 or screws and thus lock both top wall 530 and bottom wall 550 together. The top wall 530 and a bottom wall 550 may be loosened and removed at any time to gain access to a matrix formed by slats 510 that create compartments 560 containing sound generating solid masses 520. The barrel screw 580 is tightened and closed to facilitate instrument resumed performance of the sealed, solid body instrument. The slats 510 forming the solid state matrix may also be removed altogether if the performer wishes to transition from a multi-compartment instrument to a single compartment instrument.

Figure 5B:
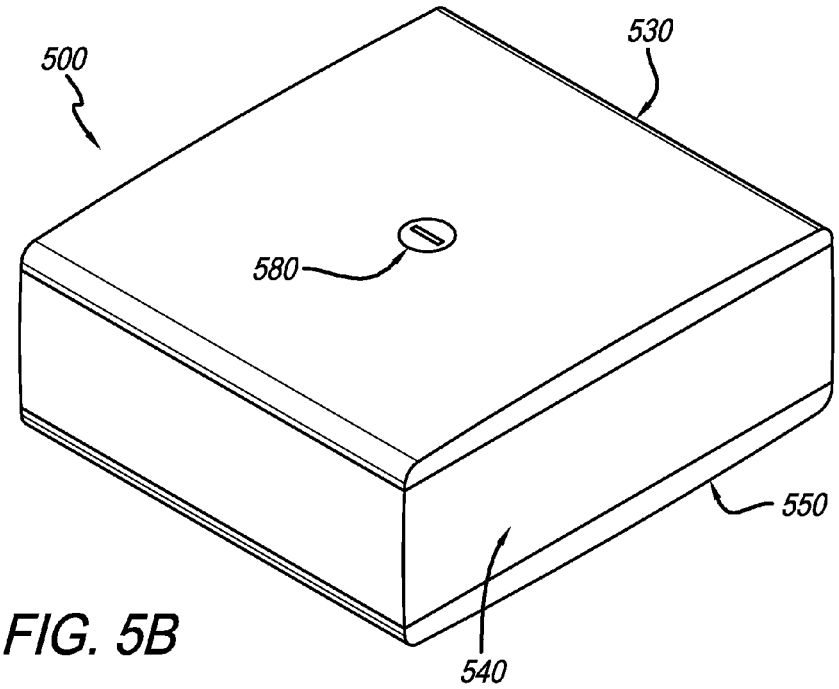
Figure 5C:
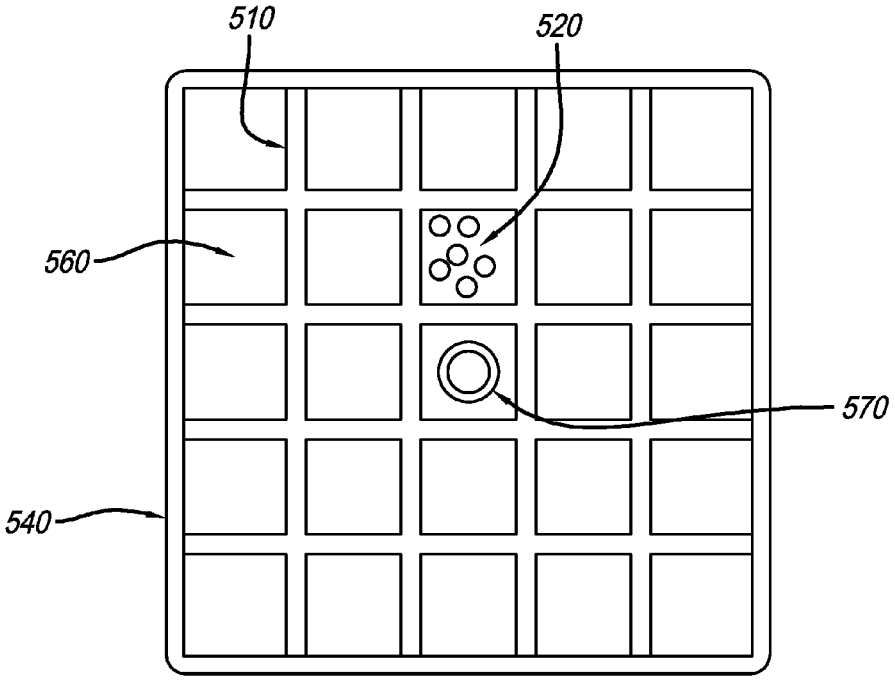
Figure 5D:
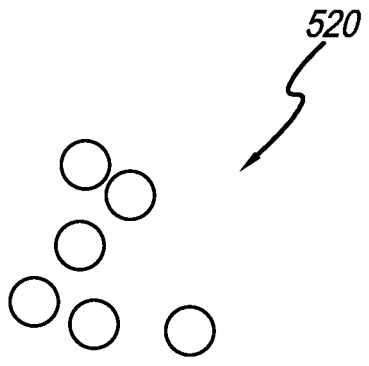
Figure 5E:
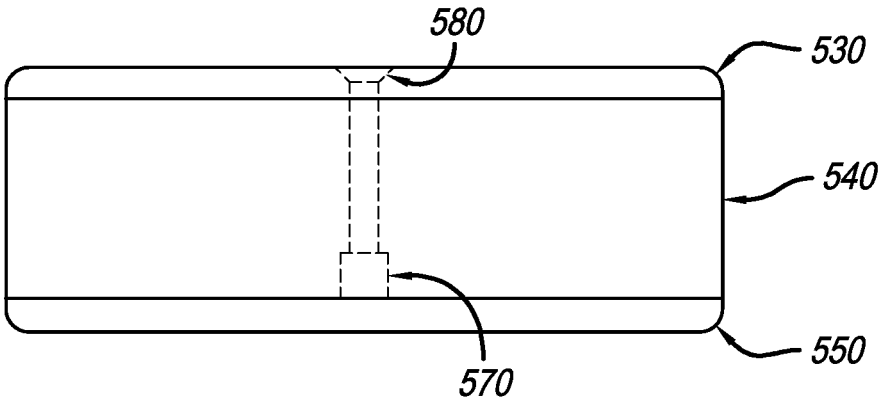

FIG. 5B shows a perspective view of the assembled cuboid-box shaker 500. FIG. 5C is a top view illustrating the slats 510 that make up the compartments 560, where the compartments 560 contain one or more solid masses 520. This figure shows that one or more threaded barrels 570 may be used for the purpose of locking the top wall 530 of the instrument to the bottom wall 550 and sealing the chambered compartments of the instrument. FIG. 5D illustrates a round type of solid masses 520. In a preferred embodiment, one or more striker materials may be placed within each chambered compartment. FIG. 5E illustrates that one or more locking screws 580 which may be used to lock into one or more threaded barrels 570 to seal the instrument and fix the top wall 530 to the bottom wall 540.

Figure 6A:
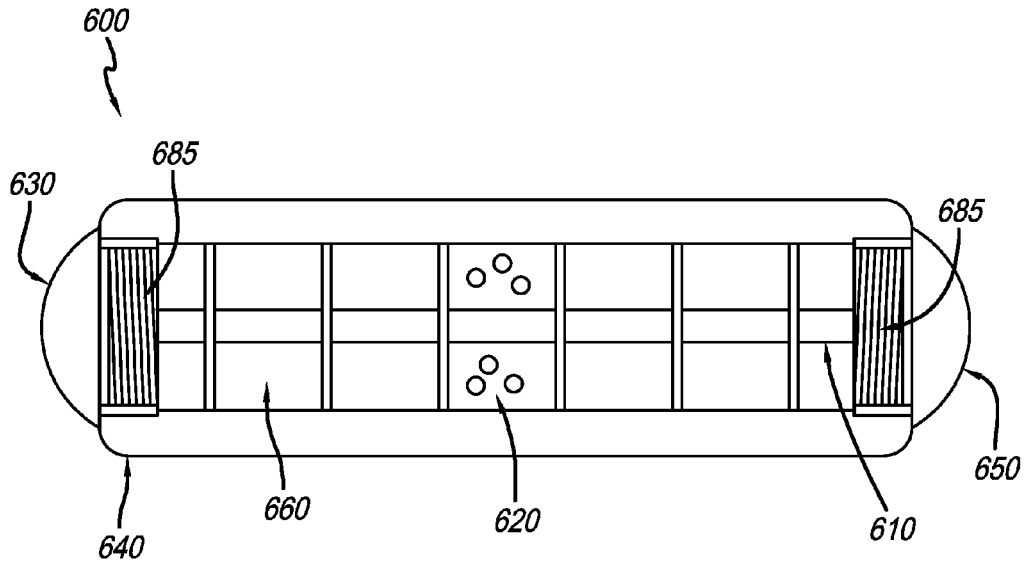
FIGS. 6A-6F depict an alternative of the second embodiment of the invention possessing a cylindrical "stick" shaker with a removable end cap and removable internal chamber component. This embodiment is another form of a "user-configurable" instrument.

The sixth embodiment, shown in a cross-sectional view in FIG. 6A, provides a user-configurable cylindrical-stick shaker 600, with a slat/rod component 610 which form compartments 660. The user of the instrument can exchange inner components and alter the instrument sound. The cylindrical-stick shaker 600 can be disassembled and re-assembled by means of threaded, locking end caps 630, 650. The end caps 630, 650 are screwed into a receiving threaded barrel/ring 685, thus sealing both ends of the cylindrical-stick shaker 600. The threaded barrel/ring 685 is fixed inside of the cylindrical-stick shaker 600 at each of the two ends. The main body is a cylinder 640 which is hollow on the inside, allowing for the insertion of the internal shaker chamber unit containing the slat/rod 610 component which make up the compartments 660. One or more compartments 660 are filled with sound generating solid masses 620. The end caps 630, 650 are screwed into place into a threaded barrel/ring 685 fitted inside the end of the main body. Fitting of the end caps 630, 650 may also be achieved by other means of locking apparatus such as inserting and twisting the end caps 630, 650 into a twist-lock mechanism located inside the wall of the cylinder 640, or snapping the end caps 630, 650 into a snap-into ring located inside the wall of the cylinder 640. When desired, the end cap 630, 650 may be loosened and removed. The shaker chamber unit can also be removed to allow the exchange of solid masses 620 for solid masses 620 of different sizes, amounts, and/or material types. The slat/rod 610 component may be removed altogether if the performer wishes to transition from a multi-compartment instrument to a single compartment instrument. The final assembly is a solid body instrument that uses no baffles or escape hole to enhance sound generation.

Figure 6B:
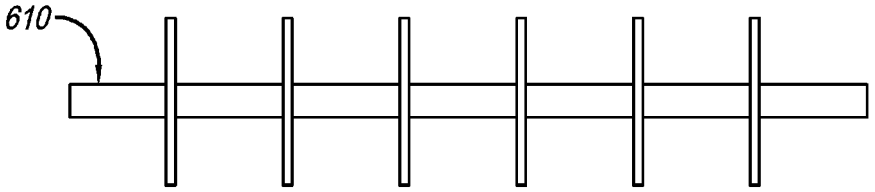
Figure 6C:
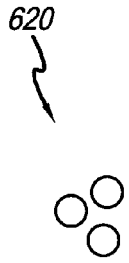
Figure 6D:
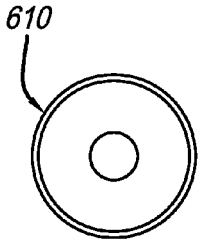
Figure 6E:
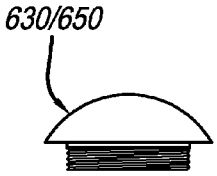
Figure 6F:
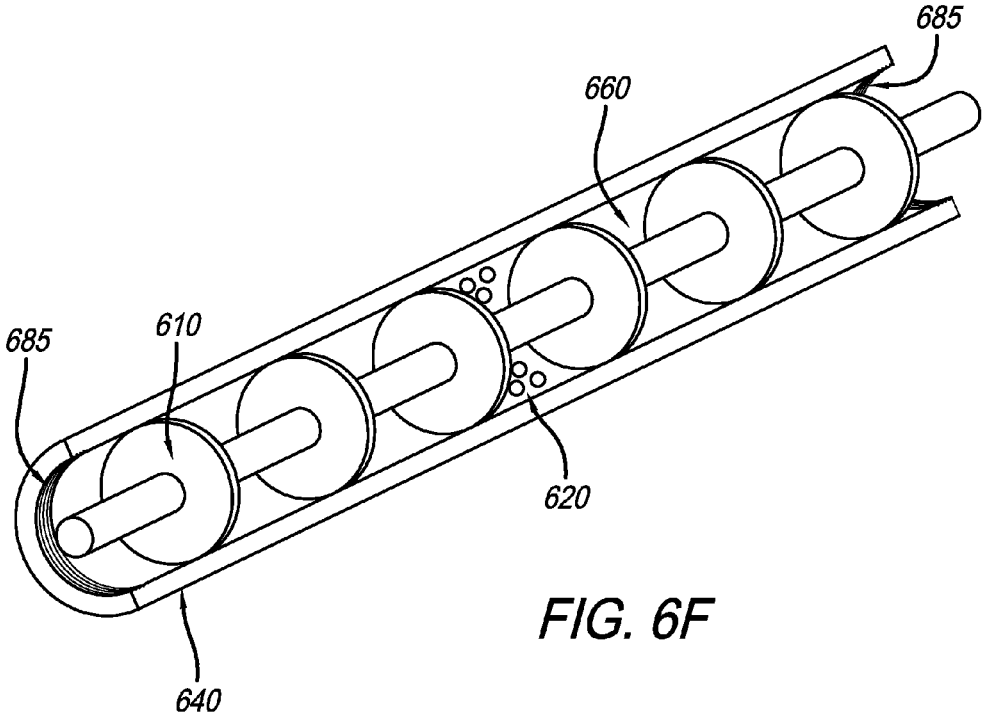

FIG. 6B shows one configuration of the slat/rod 610 component which has one or multiple walls for the creation of compartments 660 in which solid masses 620 are placed. The compartments 660 restrict the movement of the solid masses 620 and keep the solid masses 620 positioned in a single compartment 660. The slat/rod 610 component is plunger-like and facilitates insertion into and extraction from the hollow core of the cylinder 640. FIG. 6C shows a round type of solid masses 620. One or more solid masses 620 may be placed within each compartment 660. FIG. 6D illustrates the end view of a slat/rod 610 component. FIG. 6E illustrates the screw component of the end cap 630, 650. The screw of the end cap 630, 650 fits into the threaded barrel/ring 685 to open and seal the instrument. FIG. 6F depicts a cross section of the cylindrical-stick shaker 600.

The embodiments shown in FIGS. 5 and 6 demonstrate a "user-configurable" shaker instrument whose tones may be modified according to the needs and wishes of the performer. This allows for an infinite variety of sounds provided by this unique instrument architecture.

EXAMPLE 1

A cuboid-box body containing an internal matrix of compartments was constructed. The body was made of Ash wood. The top wall and a bottom wall measured 76.2 mm by 76.2 mm. The four side walls measured 19.05 mm by 76.2 mm. The thickness of the walls was 3.175 mm. Sixteen compartments measured 15.08 mm by 15.08 mm were made by wood slats. Twenty-five solid masses made out of 3 mm chromium steel balls were placed in each compartment.

EXAMPLE 2

A cylindrical, or "stick" shaker body, containing an internal matrix of compartments was constructed. The body was made of Walnut wood. The cylinder measured 215.9 mm in length by 25.4 mm in diameter. The thickness of the walls was 3 mm. Twenty compartments placed at 10 mm intervals were made with nylon washers placed onto rubber grommets and threaded onto a wood dowel. Twenty-five solid masses made out of 3 mm chromium steel balls were placed in each compartment.

EXAMPLE 3

A percussion instrument with a rectangular cuboid-box body containing an internal matrix of compartments was constructed. The body was made of Oak wood. The top wall and bottom wall measured 112 mm by 328 mm. Two side walls measured 19.05 mm by 112 mm. The other two side walls measured 19.05 mm by 328 mm. The thickness of the walls was 3 mm. 108 compartments measuring 15.08 mm by 15.08 mm were made by wood slats. Twenty-five solid masses made out of 3 mm chromium steel balls were placed in each compartment.

EXAMPLE 4

A percussion instrument with a curved box or curvilinear "stick" shaker containing a single in-line row of variable sized chambers containing an internal matrix of compartments was constructed. The body was made of Walnut wood laminate. The top wall and a bottom wall measure approximately 25.4 mm by 215.9 mm. The four side walls measure approximately 25.4 by 215.9 mm. The thickness of the walls was approximately 0.8 mm. Nineteen compartments placed at 10 mm intervals were made by a wood matrix. Twelve solid masses made out of 4.5 mm brass pellets were placed in each compartment.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure. All references cited herein are incorporated by reference in their entirety.

What is claimed is:

1. A percussion instrument comprising:

a) an enclosed body comprising a cuboid and forming a cavity, the body enclosed on all sides by a rigid top wall panel that is planar from edge to edge, a rigid bottom wall panel that is planar from edge to edge, and a continuous side wall of panels having a first end and a second end, wherein each side wall panel is permanently joined together, wherein the top wall panel is releasably joined to the first end of the side wall panels via one or more fasteners, and the bottom wall panel is releasably joined to the second end of the side wall panels via one or more fasteners for sandwiching the side wall panels between the top and bottom wall panels, wherein the width of the body is between about 25 and 600 mm, wherein the length of the body is between about 25 and 3,000 mm, wherein the height of the body is between about 3 and 150 mm, and wherein the one or more walls are between about 1 and about 25 mm in thickness;

b) a matrix comprising two or more compartments, wherein the matrix is integral to the enclosed body, and is wherein the compartments are between about 3 and 300 mm in length, between about 3 and 300 mm in width, and between 3 and 150 mm in height; and c) one or more solid masses, wherein the one or more solid masses are inserted and confined within at least one of the two or more compartments, and where the one or more solid masses are between about 1 and 100 mm in diameter.

2. A percussion instrument comprising:

a) an enclosed body forming a cavity, the body enclosed on all sides by a rigid top wall panel that is planar from edge to edge, a rigid bottom wall panel that is planar from edge to edge, and a continuous side wall of panels having a first end and a second end, wherein each side wall panel is permanently joined together, wherein top wall panel is releasably joined to the first end of the side wall panels via one or more fasteners, and the bottom wall panel is releasably joined to the second end of the side wall panels via one or more fasteners for sandwiching the side wall panels between the top and bottom wall panels and comprising a width, a length, and a height;

b) a matrix comprising two or more compartments, wherein the matrix is integral to the enclosed body, and wherein the two or more compartments are between 3 and 300 mm in length, between 3 and 300 mm in width, and between 3 and 150 mm in height; and c) one or more solid masses, wherein the one or more solid masses are inserted and confined within at least one of the two or more compartments.

3. The percussion instrument of claim 2, wherein the enclosed body comprises a cuboid shape.

4. The percussion instrument of claim 3, wherein the cuboid shape is rectangular.

5. The percussion instrument of claim 3, wherein the matrix comprises a checkerboard pattern.

6. The percussion instrument of claim 2, wherein the top wall panel, bottom wall panel, and continuous side wall panels are between about 1 and about 25 mm in thickness.

7. The percussion instrument of claim 2, wherein the enclosed body comprises a cylindrical shape.

8. The percussion instrument of claim 2, wherein the solid masses are from about 10 mm in diameter to about 100 mm in diameter.

9. The percussion instrument of claim 2, wherein the compartments comprise from 1 to 1,000 solid masses.

10. The percussion instrument of claim 2, wherein the top wall panel, bottom wall panel, and continuous side wall panels are comprised of plastic, metal, wood, rubber, nylon, vinyl, carbon fiber, or composite synthetic materials.

11. The percussion instrument of claim 2, wherein the matrix is comprised of plastic, metal, wood, rubber, nylon, vinyl, carbon fiber, or composite synthetic materials.

12. The percussion instrument of claim 2, wherein the solid masses are comprised of plastic, metal, wood, rubber, nylon, dried beans, rice, pebbles, vinyl, carbon fiber, or composite synthetic materials.

13. The percussion instrument of claim 2, wherein the solid masses comprise from one percent to seventy-five percent of the volume of at least one of the two or more compartments.

14. The percussion instrument of claim 2, wherein the number of compartments comprise from 2 to 40,000 compartments.

* * * * *